US006857234B2

(12) United States Patent
Goudreau et al.

(10) Patent No.: US 6,857,234 B2
(45) Date of Patent: Feb. 22, 2005

(54) MASONRY CONTROL JOINT GUIDE

(76) Inventors: Anthony J. Goudreau, 123 Alexander Ave., Scotia, NY (US) 12302; Elio Stocchetti, 1112 McKinley Ave., Rotterdam, NY (US) 12303

( * ) Notice: Subject to any disclaimer, the term of this patent is extended or adjusted under 35 U.S.C. 154(b) by 0 days.

(21) Appl. No.: 10/374,638

(22) Filed: Feb. 26, 2003

(65) Prior Publication Data

US 2004/0163339 A1 Aug. 26, 2004

(51) Int. Cl.[7] ..... E04H 1/00

(52) U.S. Cl. ..... 52/243; 52/749.13; 52/379; 33/408

(58) Field of Search ..... 52/745.09, 243, 52/745.1, 749.13, DIG. 1, 378, 379, 713, 513; 33/404, 405, 406, 407, 408, 410, 510, 371

(56) References Cited

U.S. PATENT DOCUMENTS

| | | | | | |
|---|---|---|---|---|---|
| 1,060,284 | A | * | 4/1913 | Platt | 33/410 |
| 1,924,724 | A | * | 8/1933 | Olney | 52/379 |
| 1,989,141 | A | | 1/1935 | Leonard | |
| 2,503,098 | A | * | 4/1950 | Crocker | 33/410 |
| 2,672,691 | A | * | 3/1954 | Sears et al. | 33/406 |
| 3,130,500 | A | | 4/1964 | Bongiovanni | |
| 3,348,312 | A | * | 10/1967 | Jones | 33/406 |
| 3,397,458 | A | * | 8/1968 | Wicklund | 33/410 |
| 3,861,104 | A | * | 1/1975 | Bower | 52/283 |
| 4,144,649 | A | | 3/1979 | Huston | |
| 4,359,850 | A | | 11/1982 | Sinkes | |
| 4,631,833 | A | | 12/1986 | Moye | |
| 4,720,952 | A | * | 1/1988 | Fricker | 52/235 |
| 4,939,846 | A | | 7/1990 | Damiano et al. | |
| 4,970,797 | A | | 11/1990 | Sarasin | |
| 4,995,167 | A | | 2/1991 | Sanchez | |
| 6,293,066 | B1 | | 9/2001 | Lohrey | |
| 6,430,826 | B1 | | 8/2002 | Sigl | |
| 6,519,980 | B1 | * | 2/2003 | Walker | 66/147 |
| 6,629,680 | B2 | * | 10/2003 | Weck et al. | 248/475.1 |
| 6,640,456 | B2 | * | 11/2003 | Owoc et al. | 33/382 |

FOREIGN PATENT DOCUMENTS

| | | |
|---|---|---|
| WO | WO 93/16255 | 8/1993 |

* cited by examiner

*Primary Examiner*—Kimberly Wood
(74) *Attorney, Agent, or Firm*—Michael F. Hoffman, Esq.; Hoffman, Warnick, & D'Alessandro LLC

(57) ABSTRACT

A plumbing system and method for plumbing a control joint in a masonry wall. The plumbing system comprises: a bracket mountable to an interior wall surface, wherein the bracket includes an extension having a guiding system; and a vertically oriented plumb rod that can be engaged through the guiding system and placed within the control joint as the masonry wall is erected.

12 Claims, 5 Drawing Sheets

MASONRY CONTROL JOINT GUIDE

BACKGROUND OF THE INVENTION

1. Technical Field

The present invention relates generally to plumbing control joints in masonry walls, and more particularly to a method and apparatus for plumbing a control joint in a brick wall.

2. Related Art

Control joints are engineered into modern buildings to compensate for anticipated movement. Movement may, for instance, be caused by: (1) thermal expansion and contraction of similar materials; (2) thermal expansion and contraction differentials between dissimilar materials; (3) geological movement or settlement; (4) engineered flexibility in the design of the building; or (5) vibration barriers between areas holding heavy equipment or areas subject to vehicular traffic vibration. Control joints allow segments of a structure to move independently of each other while retaining the integrity of the structure.

A common type of control joint that is utilized in masonry walls comprises a vertical "seam" that separates horizontally adjacent sections of masonry material (e.g., brick). The thickness and placement of the control joint will vary depending upon the type of wall, climate, etc. An example of this is depicted in FIG. 1, in which a brick wall 10 is shown having a control joint 12. The resulting wall is, in essence, two independent wall sections separated by a thin vertical seam.

While the use of control joints improves the stability of a structure, their use creates new challenges for the masons laying the brick. In particular, as the wall is being erected, the mason must ensure that each control joint is plumb, i.e., at a right angle to level ground. Failure to properly plumb each control joint may compromise the building structure. Given the widespread use of control joints, the process of precisely installing control joints can add a substantial amount skill, time and cost skill to a project. Accordingly, a need exists for a low cost device that will facilitate the process of plumbing control joints in a masonry structure.

SUMMARY OF THE INVENTION

The present invention addresses the above-mentioned problems, as well as others, by providing an easy to use control joint plumbing system and method. In a first aspect, the invention provides an apparatus for plumbing a control joint in a masonry wall, comprising: a bracket mountable to an interior wall surface, wherein the bracket includes an extension having a guiding system; and a vertically oriented plumb rod that can be engaged through the guiding system and placed within the control joint as the masonry wall is erected.

In a second aspect, the invention provides a method of plumbing a control joint in a masonry wall, comprising the steps of: providing a bracket that includes an extension having a plurality of holes for holding a downwardly extending plumb rod; selecting one of the holes to hold the downwardly extending plumb rod; placing the bracket against an interior wall such that the plumb rod extends vertically downward; adjusting the position of the downwardly extending plumb rod until a bottom of the plumb rod sits at a desired location of the control joint; adjusting the position of the bracket along the interior wall while maintaining the position of the bottom of the plumb rod until the plumb rod is plumb; and fastening the bracket to the interior wall.

In a third aspect, the invention provides an apparatus for plumbing a control joint in a masonry wall, comprising: (1) a bracket mountable to an interior wall surface, wherein the bracket includes: (a) a mounting plate having mounting holes for receiving screws to affix the bracket to the interior wall, and (b) an extension having a plurality of rod holes distally spaced from the mounting plate; and (2) a vertically oriented plumb rod that can be engaged through a selected one of the rod holes and maintained within the control joint as the masonry wall is erected.

BRIEF DESCRIPTION OF THE DRAWINGS

These and other features of this invention will be more readily understood from the following detailed description of the various aspects of the invention taken in conjunction with the accompanying drawings in which.

DETAILED DESCRIPTION OF THE DRAWINGS

Figure 1:
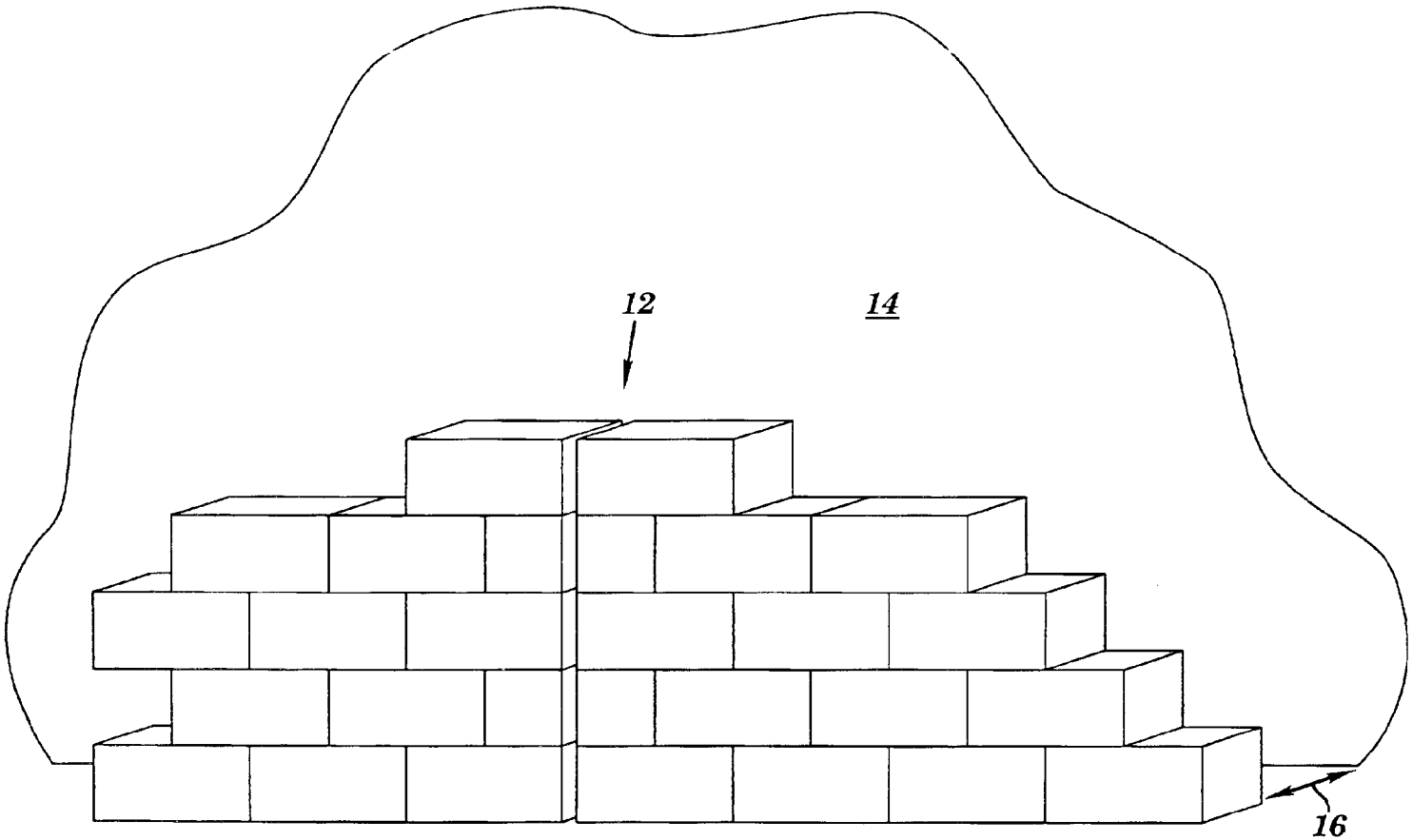
FIG. 1 depicts a masonry wall being built with a control joint.

As noted above, the present invention provides a system and method for plumbing a control joint within a masonry wall. For the purposes of the disclosure, the term "control joint" may include any type of joint within a wall, including expansion joints, seams, an edge, etc. Moreover, it should be understood that the invention could be used for any type of masonry wall, including brick, stone, composite, etc. FIG. 1 depicts an exemplary masonry wall 10 that includes a control joint 12. As can be seen, masonry wall 10 is built in front of an interior wall 14 such that a space 16 is created between the interior wall 14 and masonry wall 10. Such a configuration is typical in the art.

Figure 2:
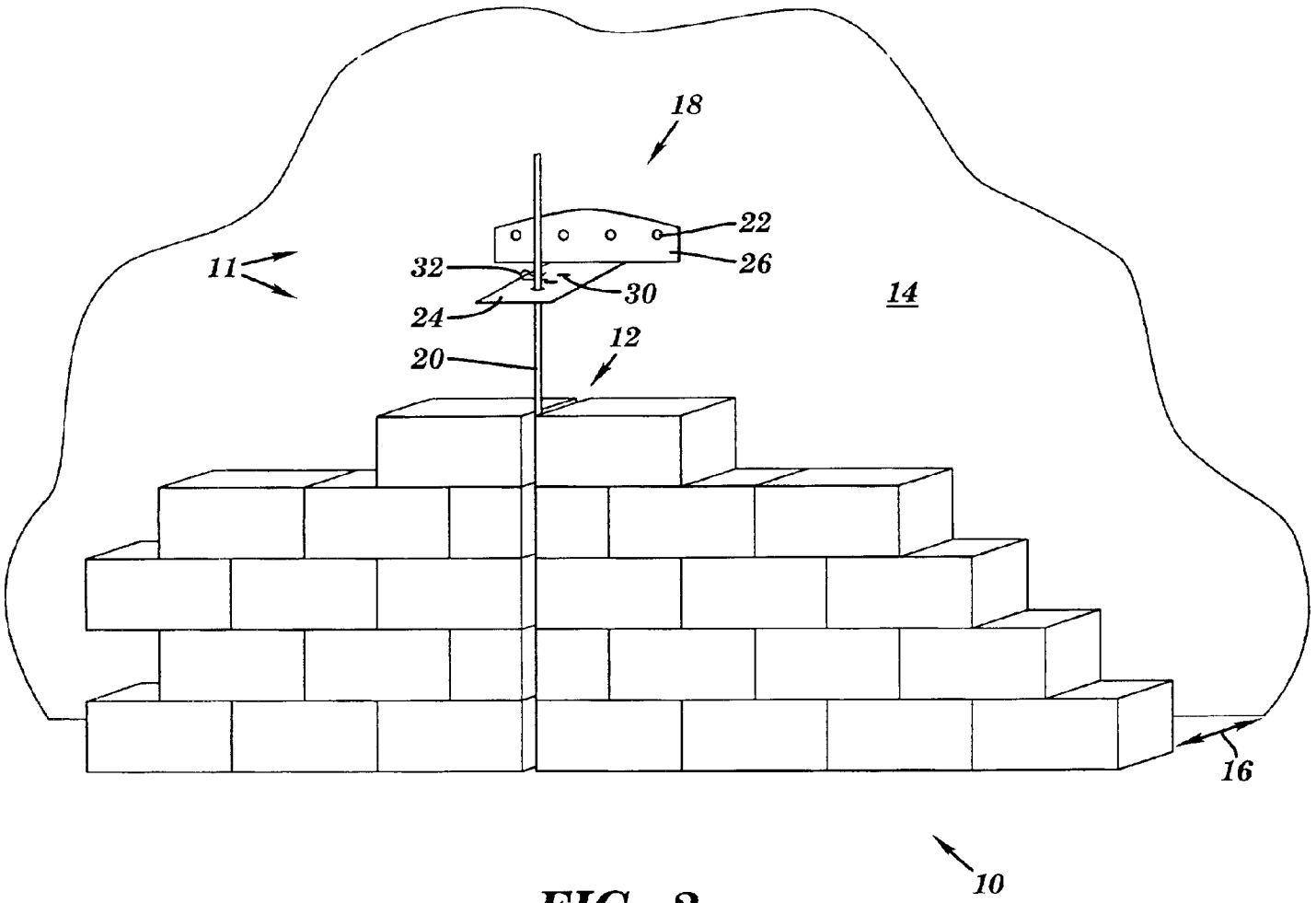
FIG. 2 depicts the masonry wall of FIG. 1 with a plumbing system in accordance with the present invention.

Referring now to FIG. 2, an exemplary plumbing system 11 according to the present invention is shown for the wall depicted in FIG. 1. Plumbing system 11 generally includes a bracket 18 and a plumb rod 20. Bracket 18 includes a mounting plate 26 and an extension 24. Mounting plate 26 includes a plurality of holes 22 that allow bracket 18 to be removably connected to interior wall 14. In a typical embodiment, interior wall may comprise a material such as plywood, particle board, sheet rock, etc., and the bracket 18 may be affixed to interior wall 14 using screws, e.g., sheet rock screws. However, it should be understood that the invention can be configured to work with any type of interior wall, including cinder blocks, cement, vinyl, etc. Extension 24 extends outwardly from the mounting plate 26 in a generally horizontal direction such that the extension 24 sits above the control joint 12 as the wall is being erected. Extension 24 includes a guiding system for slidably engaging plumb rod 20 in a vertical direction. In this exemplary embodiment, the guiding system comprises a plurality of vertically oriented rod holes 30 that allows the plumb rod to extend vertically downward. Depending on the space 16 between the masonry wall 10 and the interior wall, a different one of the holes 30 can be selected in order to ensure that the plumb rod will sit at the desired position within the control joint 12, as the masonry wall 10 is being built.

Plumb rod 20 may be made from any material, such as steel, stainless steel, plastic, composite, etc., and be designed with any cross-section (e.g., circular, oval, rectangular, polygonal, etc.) and length. In an exemplary embodiment, the rod 20 comprises a ⅜ inch round cross-section and is about six feet in length. In addition, plumb rod 20 may include a stop mechanism, such as a cotter pin 32, to keep the rod 20 within the guiding system. It should be understood that any type of stopping mechanism that provides the feature of holding the rod 20 in the guiding system may be used. As described in more detail below, the plumb rod 20 can be raised as necessary, as the wall is erected, by unscrewing the bracket 18 from interior wall 14, raising it, and re-fastening the bracket 18 to the interior wall at a higher position.

Figure 3:
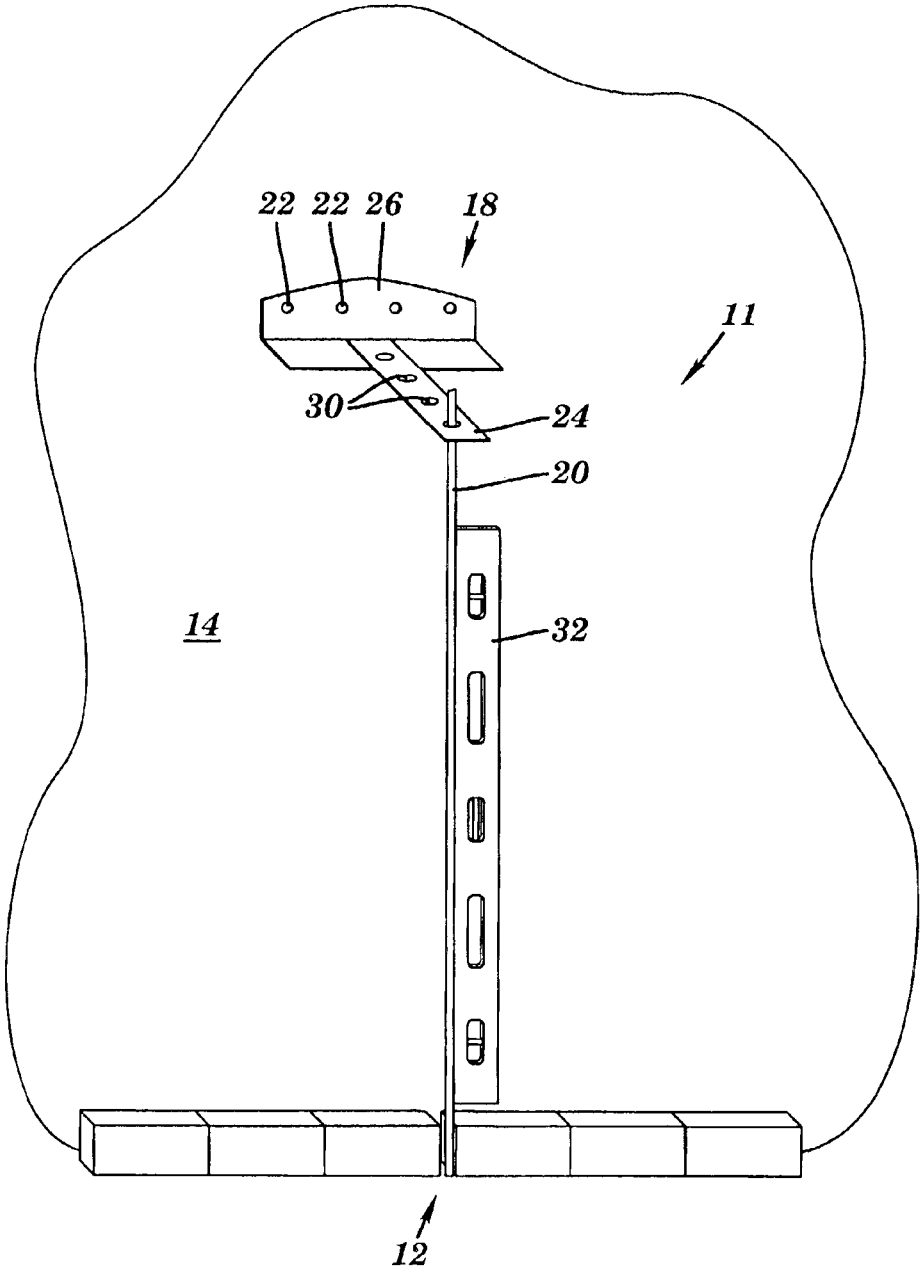
FIG. 3 depicts a plumbing system in accordance with the present invention.

An exemplary method of operation of the plumbing system 11 is described in further detail with regard to FIG. 3. First, the plumb rod 12 is placed through a selected rod hole 30 in the extension 24. In a typical application, the hole is chosen such the rod will be about one inch inside the wall line of the masonry wall. Next, the mounting plate 26 of bracket 18 is placed flat against the interior wall allowing the plumb rod 20 to hang straight down. The bottom end of the rod 12 is then placed at the desired location of the control joint. A level 32 can then be placed against the rod 12. Bracket 18 can be moved left or right to plumb the rod 12. Once the rod is plumb, bracket 18 can be screwed into the interior wall using two or more of the mounting holes 22. The masonry wall can then be erected.

Once the masonry wall has been erected to within a few courses below the bottom of bracket 18, the bracket 18 can be unscrewed from the wall, and raised. In an exemplary embodiment, the plumb rod should be placed 3–4 courses down into the partially erected wall. To maintain straightness of the control joint, an alternate side of the rod may lay against each course. When the wall is complete, or at the end of the day, the plumb system can be removed, and reused over and over again.

Figure 4:
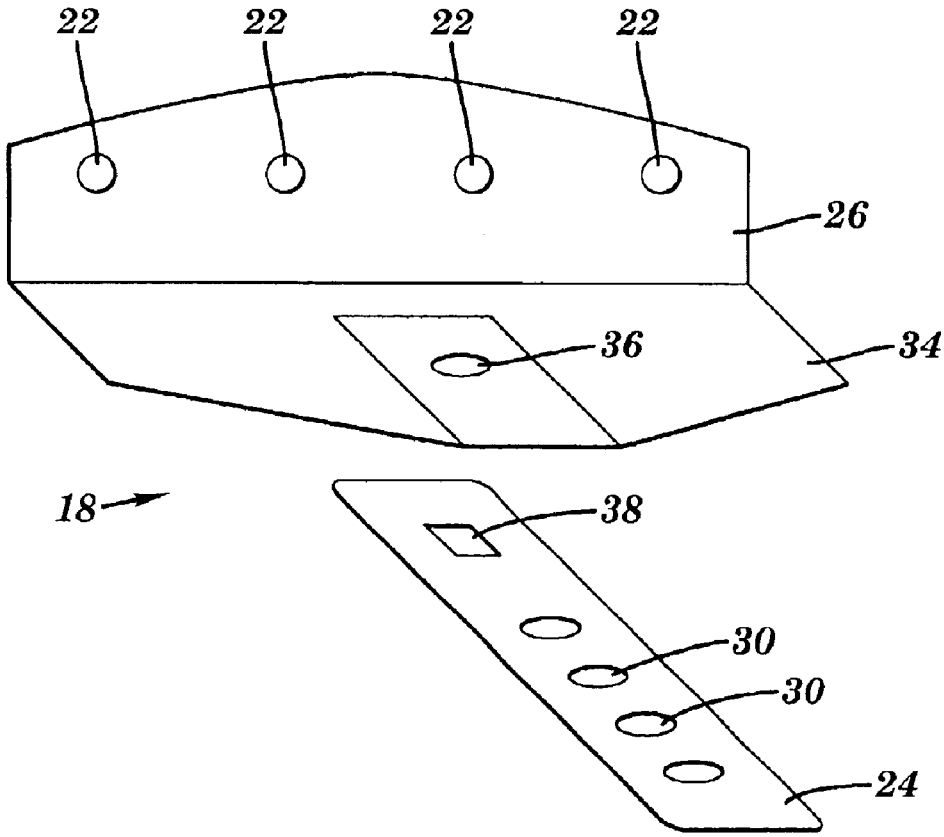
FIG. 4 depicts an exploded view of a two-piece bracket in accordance with one embodiment of the present invention.

Bracket 18 can be constructed in any shape or size, and is not limited to the descriptions provided herein. Bracket 18 may be constructed from a single, or from multiple pieces of material, and any material may be used, e.g., metal, plastic, composite, etc. FIG. 4 depicts an exploded view of an exemplary embodiment of a two-piece bracket 18. Such a two-piece design may be more easily packaged, as opposed to a one piece design. As can be seen, bracket 18 includes: a mounting plate 26 having four mounting holes 22; a shelf 34 having a shelf hole 36; and an extension 24 having an extension hole 38 and four rod holes 30. Extension 24 mounts onto shelf 34 (e.g., either above or below), by placing a bolt through holes 36 and 38. The guiding system of this embodiment utilizes four rod holes 30, spaced about an inch apart. However, it should be understood that any guiding system that can hold rod 20 in place could be utilized, including using more or less than four holes, using one or more vertically oriented collars, etc.

Figure 5:
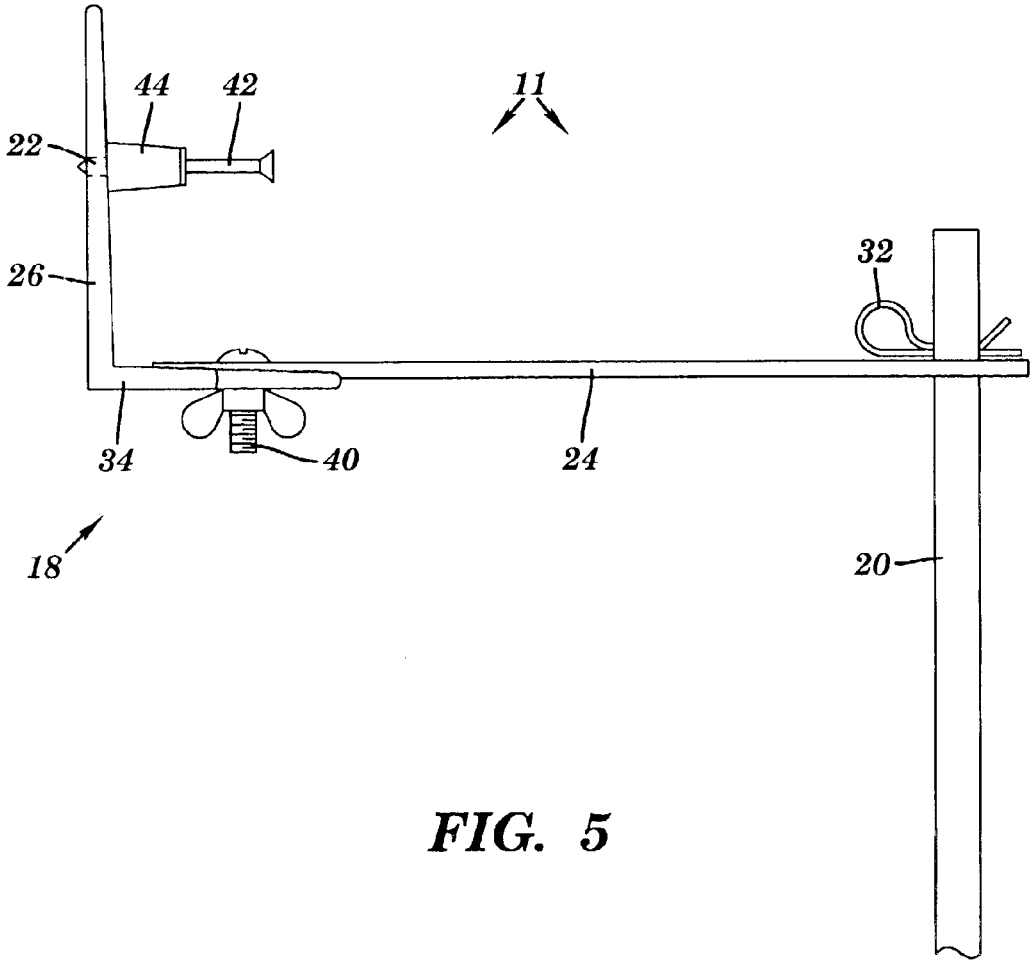
FIG. 5 depicts a side view of the two-piece bracket of FIG. 4.

FIG. 5 depicts a side view of the complete bracket 18 of FIG. 4, with the rod 20 installed. As can be seen, extension 24 is attached to shelf 34 of bracket 18 using a carriage bolt and wing nut 40. A sheet rock screw 42 is shown position in mounting hole 22 on the mounting plate 26. In this case, the screw is held in place using a nylon flanged bushing 44. This allows for quick and easy fastening/removal of the bracket 18 to the interior wall. The rod is maintained in place with a cotter pin 32.

The foregoing description of the preferred embodiments of the invention has been presented for purposes of illustration and description. They are not intended to be exhaustive or to limit the invention to the precise form disclosed, and obviously many modifications and variations are possible in light of the above teachings. Such modifications and variations that are apparent to a person skilled in the art are intended to be included within the scope of this invention as defined by the accompanying claims.

What is claimed is:

1. A method of plumbing a control joint in a masonry wall, comprising the steps of:

providing a bracket that includes an extension having a plurality of holes for holding a downwardly extending plumb rod;

selecting one of the holes to hold the downwardly extending plumb rod;

placing the bracket against an interior wall such that the plumb rod extends vertically downward, wherein a distal end of the plumb rod is freely movable with respect to the extension to provide a plumbing function;

adjusting the position of the downwardly extending plumb rod until a bottom of the plumb rod sits at a desired location of the control joint, wherein the control joint comprises a vertical seam that separates two horizontally adjacent sections of the masonry wall, and wherein the plumb rod is placed within the control joint such that the plumb rod is within a wall line of the masonry wall;

adjusting the position of the bracket along the interior wall while maintaining the position of the bottom of the plumb rod until the plumb rod is plumb; and fastening the bracket to the interior wall.

2. The method of claim 1, wherein the plumb rod is plumbed with a level.

3. The method of claim 1, wherein after the masonry wall is built up to a point proximate the bracket, the bracket is removed from the interior wall and raised to a new position.

4. The method of claim 3, wherein the steps of placing the bracket, adjusting the position of the plumb rod, adjusting the position of the bracket, and fastening the bracket are repeated.

5. The method of claim 1, wherein the step of fastening the bracket to the interior wall includes using screws.

6. The method of claim 1, wherein the step of selecting one of the holes to hold the downwardly extending plumb rod includes the step of placing the plumb rod in the selected hole.

7. An apparatus for plumbing a control joint in a masonry wall, comprising:

a bracket mountable to an interior wall surface, wherein the bracket includes:

a mounting plate having mounting holes for receiving screws to affix the bracket to the interior wall, and an extension having a plurality of rod holes distally spaced from the mounting plate; and a vertically oriented plumb rod that can be engaged through a selected one of the rod holes and maintained within the control joint as the masonry wall is erected, wherein a distal end of the plumb rod is freely movable with respect to the extension to provide a plumbing function, wherein the control joint comprises a vertical seam that separates two horizontally adjacent sections of the masonry wall, and wherein the plumb rod may be placed within the control joint such that the plumb rod is within a wall line of the masonry wall.

8. The apparatus of claim 7, wherein the mounting plate and extension are removably attached together.

9. The apparatus of claim 7, wherein the mounting plate and extension are removably attached with a bolt and wingnut.

10. The apparatus of claim 7, wherein the mounting holes include bushings for holding at least one screw in place.

11. The apparatus of claim 7, wherein the plumb rod includes a cotter pin for holding the plumb rod within the selected rod hole.

12. The apparatus of claim 7, further including a level for plumbing the plumb rod.

* * * * *